United States Patent [19]

DeBernard, Jr. et al.

[11] 4,188,430

[45] Feb. 12, 1980

[54] MULTILEVEL COLORWAY CARPET SYSTEM

[75] Inventors: Lewis M. DeBernard, Jr., Richmond; Donald G. Mercer, Chester, both of Va.

[73] Assignee: Allied Chemical Corporation, Morris Township, N.J.

[21] Appl. No.: 914,452

[22] Filed: Jun. 12, 1978

Related U.S. Application Data

[63] Continuation-in-part of Ser. No. 800,268, May 25, 1977, abandoned.

[51] Int. Cl.[2] ..... B32B 3/02

[52] U.S. Cl. ..... 428/88; 8/14; 8/17; 8/66; 8/114; 8/115.7; 428/89; 428/92; 428/97

[58] Field of Search ..... 428/88, 89, 92, 97; 8/14, 17, 66, 114, 115.7, 1 XB; 112/410

[56] References Cited

U.S. PATENT DOCUMENTS

| | | | |
|---|---|---|---|
| 2,699,593 | 1/1955 | Matthews | 428/88 |
| 2,754,578 | 7/1956 | Groat | 428/88 |
| 2,923,099 | 3/1960 | Moonan | 428/89 |
| 2,955,346 | 10/1960 | Walmsley | 428/89 |

*Primary Examiner*—Marion E. McCamish
*Attorney, Agent, or Firm*—Richard A. Anderson

[57] ABSTRACT

A cut/loop or cut pile carpet having a beneath-the-surface patterning effect is fabricated from at least two yarn groups:

(A) a multiple ply heat-set yarn having a relatively light dye affinity combined with a nonheat-set yarn having a first relatively darker dye affinity, and (B) a heat-set yarn having a relatively light dye affinity combined with a nonheat-set yarn having a second relatively darker dye affinity, so that the nonheat-set yarns shrink to a lower pile height than the heat-set yarn(s) due to heat and moisture during dyeing and drying the carpet, whereby at least two colorways are established in the carpet.

57 Claims, No Drawings

MULTILEVEL COLORWAY CARPET SYSTEM

CROSS-REFERENCE TO RELATED APPLICATIONS

This application is a continuation-in-part of Application Ser. No. 800,268, filed May 25, 1977, now abandoned.

BACKGROUND OF THE INVENTION

This invention relates to a pile fabric intended for use as a carpet or rug. Particularly, this invention relates to a carpet and method for fabricating (tufting or weaving, etc.) carpet having a beneath-the-surface patterning effect, i.e., at least two colorways, by fabricating from at least two yarn groups, both made from the light dyeing heat-set yarn and a darker dyeing nonheat-set yarn. The darker dyeing nonheat-set yarn components of the two yarn groups have different dyeability characteristics.

It is known in the prior art to achieve different degrees of dye acceptability in synthetic filament yarn by using two different heat-setting temperatures in U.S. Pat. No. 3,177,644. This patent also teaches heat-setting temperatures to control denier and crimp recovery with modeacrylic yarn. No mention is made of nonheat-set yarn or two combined or cabled yarns, since only one plied yarn is used. There is no teaching of different "pull down" heights of tuft due to different heat-setting treatment.

In U.S. Pat. No. 2,200,134, stretched and nonstretched acetate filaments are used to create a crepe effect in apparel fabric.

Another apparel patent, U.S. Pat. No. 3,039,171, achieves a spun yarn look for nylon fabric from a combined high shrink steamed yarn with a low shrink nonsteamed yarn having the same dyeability. Differences in dyeability were considered undesirable.

Different colored yarns are used to make a pattern effect by high-low tufting with a zig zag pattern to hide one color, exposing another, then exposing both colors, then exposing another color, etc. in U.S. Pat. No. 4,000,707. This is a typical hidden loop pattern of tufting. The patent makes no teaching of a combination of heat-set and nonheat-set yarns. Also, the effect is to conceal the hidden loops so that there is no beneath-the-surface patterning effect and no multiple colorway effect.

U.S. Pat. No. 3,971,202 described cobulking a normal yarn with a special yarn such as an antistatic yarn, a yarn having an unusual dyeability, etc., where the special yarn is 4 to 20 percent longer. This increases the appearance of the second fiber at the surface of the cobulked yarn.

Cospinning different polyester polymers for a mixed shrinkage yarn is disclosed in U.S. Pat. No. 3,998,042. Another mixed shrinkage yarn is disclosed in U.S. Pat. No. 3,939,636. This yarn is made of aromatic polyamides of different chemical structure.

U.S. Pat. No. 3,707,344 describes a differential dyeing textile by piecing dyeing in a single bath an antistatic yarn, an unmodified yarn, a yarn having amine ends and/or a yarn containing sulfonate groups.

U.S. Pat. No. 3,900,623 teaches manufacture of cut pile carpets without twist setting the plied yarns before tufting. It describes the formation of coherent tufts by unwinding and entangling of cut filaments only at the tops of the tufts. As background, Research Disclosure of April, 1976, in disclosure 11453 describes the background of the yarns necessary to practice this invention.

A high-low carpet by chemical fiber shrinking is disclosed in U.S. Pat. Nos. 3,849,157 through 3,849,159. In U.S. Pat. No. 3,830,683, a steam-etched solvent embossed carpet is made by steaming after printing. The printing solution has a solvent for the fiber which causes the fiber to shrink and/or partially dissolve.

U.S. Pat. No. 3,899,562 discloses extruded monofilaments of different colors intermixed to provide homogeneous cross-section yarn.

Bis-cationic dyes are described in U.S. Pat. No. 3,759,893, hereby incorporated by reference, in order to include the background regarding dyeing of the chemically modified nylon polymers described therein.

U.S. Pat. No. 3,706,524 describes cationic and anionic dyeing of mixed fibers.

SUMMARY OF THE INVENTION

The multilevel colorway carpet system of this invention is not described in the prior art because there is no teaching of a beneath-the-surface patterning effect achieved by tufting from at least two yarns cabled or combined in other ways from a heat-set yarn combined with a non-heat yarn to create differential shrinkage or "pull down" of the yarn tuft in the carpet due to the heat and moisture during dyeing and drying of the carpet. The multilevel colorway yarn system employs two or more yarn groups which are placed in a cut/loop or cut pile carpet construction by tufting, weaving or other methods. Each yarn group contains a heat-set yarn bundle or end plied, cabled or combined in some way with a nonheat-set yarn bundle or end. The heat-set yarn may be of different or similar dye affinity. The nonheat-set yarn should have different dye affinities.

By use of the unique system of heat-set yarn combined with nonheat-set yarn, a patterned multilevel colorway effect is achieved on cut pile or cut loop carpet for piece dyeing or for Kuster, TAK or printing. This multilevel colorway system contains a surface color and a beneath-the-surface color in the carpet pile. Although nonheat-set yarns have been used with heat-set yarns before, different dye affinity of nonheat-set yarns have never been used to create a beneath-the-surface patterned effect.

The yarn in the system of this invention can be any of the known synthetic or natural yarns used in carpeting, so long as nonheat-set and heat-set yarns have differential shrinkage. For example, nylon, polyester, acrylic and wool or mixtures could be used, but nylon and particularly nylon 6 is preferred.

A colorway as described herein, is a set of one or more colors appearing at a specific level or depth on or beneath the surface or pile of the carpet. For example, a desired effect is a subtle monotone look seen only when viewed from an angle of about 30 degrees above the level of the carpet and not actually visible on the same carpet. When looking straight down, a contrasting beneath-the-surface patterned colorway effect is seen.

The system of this invention is useful to fabricate cut pile and cut/loop fabrics intended for carpets or rugs. These fabrics can be made on conventional tufting or weaving machinery found in carpet mills, or on more recently developed machinery.

Weaving machinery and weaving patterns capable of utilizing this yarn system are well known in the art.

Typical cut pile tufting machinery which can be used to make fabric using this yarn group system are as follows:

(1) The conventional ultratuft machine, a cut pile tufting machine with a stepping needle bar.

(2) The conventional controlled needle cut pile tufting machine, where the tufting needles either tuft pile from the yarn creel or omit making a tuft according to pattern directions.

(3) Any type of carpet fabricating machinery capable of using the system described herein, such as ultrasonic tuft bonding, thermal fusion tuft binding and others.

By cut/loop carpet is meant any carpet made on a machine with a pattern that creates cut pile tufts and loop tufts in the same carpet.

The carpet of this invention is a carpet selected from the group consisting of cut/loop and cut pile carpet having a beneath-the-surface patterning effect. The carpet comprises at least two yarn groups of different characteristics. The yarn groups comprise (A) a multiple ply heat-set yarn having a relatively light dye affinity combined with a nonheat-set yarn having a first relatively darker dye affinity and (B) a heat-set yarn having a relatively light dye affinity combined with a nonheat-set yarn having a second relatively darker affinity, so that the nonheat-set yarns shrink to a lower pile height in the carpet than the heat-set yarns due to the heat and moisture of dyeing and drying of the carpet, whereby at least two colorways are established in the carpet pile.

When tufted on cut/loop machine, the carpet can be tufted with a hidden loop or a semihidden loop pattern. Yarn groups (A) and (B) can have the same heat-set yarn component or they can have a heat-set yarn component of differing caracteristics. Differing characteristics can be the number of plies in the yarn, the denier or cotton count of the yarn (denier applies to bulked continuous filament yarn and cotton count applies to staple carpet yarn), and/or light dye affinity of the heat-set yarn component. Regarding plies and/or denier or cotton count, the nonheat-set yarn characteristics can also be the same or different. The yarn groups (A) and (B) can be tufted in an end and end relationship or in a random relationship.

This invention also includes carpet wherein the yarn groups (A) and (B) are tufted with an additional yarn group (C). The third yarn group (C) can be made of any kind of yarn. Preferably, the yarn group (C) comprises a heat-set yarn of a relatively light dye affinity combined with a nonheat-set yarn having a third relatively different dye affinity. When tufted in cut/loop machine, the carpet using yarn groups (A), (B) and (C) can also be tufted with a hidden loop or semihidden loop pattern and the three yarn groups (A), (B) and (C) can have the same heat-set yarn component or a heat-set yarn component of differing characteristics. The different characteristics of the nonheat-set or the heat-set yarn component can be the number of plies, dye affinity, denier or cotton count or any combination of them. This carpet of yarn groups (A), (B) and (C) can be tufted in an end, and end, and end relationship or a random relationship.

Various additional yarns can be tufted with the yarn groups (A), (B), and (C). The additional yarn can be any kind of yarn. At least one of the additional yarns preferably can have at least one yarn component having a characteristic differing additional yarns preferably can have at least one yarn component having a characteristic differing from each of the yarn groups (A), (B), and (C). At least one additional yarn preferably can have a heat-set yarn component of the same or similar light dye affinity as yarn in groups (A), (B), and/or (C). Also, at least one additional yarn can have a nonheat-set yarn component having a characteristic different than the nonheat-set yarn component of yarn groups (A), (B), and (C). The above different characteristics of the heat-set or the nonheat-set yarn component of the additional yarn can be the number of plies, denier or cotton count and/or dye affinity.

The method of this invention is to make a beneath-the-surface patterning effect for cut/loop and cut pile carpets of at least two yarn groups of different characteristics comprising fabricating (tufting or weaving or any other carpet fabricating device) the yarns into a pile fabric pattern that will establish at least two colorways, dyeing the carpet tufted from the yarn and drying the carpet. The yarn groups used in the method are the same yarns as described above labeled (A) and (B). These yarn groups are used to achieve the differing shrinkage characteristics described above to give at least two colorways in a carpet pile. The method of this invention can tuft the yarn groups (A) and (B) in an end and end relationship or a random relationship. The method can also use yarn groups (A) and (B) having the same heat-set yarn component or a heat-set yarn component of different characteristics in yarn groups (A) and (B). The different characteristics of the yarn used in the method can be as set forth above, that is, the number of plies in the yarn, the denier or cotton count of the yarn, and/or the light dye affinity of the yarn.

The method of this invention can also be used to fabricate the carpet from yarn groups (A), (B), and (C) as set forth above where yarn group (C) preferably comprises a heat-set yarn of relatively light dye affinity combined with a nonheat-set yarn having a relatively dark dye affinity. However, yarn group (C) can be any yarn or combination of yarns. When this third yarn group (C) is used, a different characteristic of the heat-set or the nonheat-set yarn component can still be the number of plies, dye affinity, denier or cotton count or any combination of them.

The combinations of yarn groups (A), (B), and (C) of the same or different relationships can also be as set forth above in the description of the carpet made from these three yarn groups.

DISCUSSION

Each of the yarn groups labeled (A), (B) and preferably (but not necessarily) (C) or the various additional yarns added can be described as follows: Each yarn represents a unique yarn bundle being fabricated (tufted, woven or other method) into a carpet and may employ staple, bulked continuous filament or a combination of staple and bulked continuous filament yarns. The nature of the heat-set as opposed to the nonheat-set portion of the yarns should allow a shrinkage difference to occur upon dyeing, drying and finishing of the carpet. Nonheat-set yarns should shrink to a lower pile height (pull down) than the heat-set yarn. The method of heat-setting or twist setting can be autoclaving, Relset, Superba heat-set or any other type of heat-set. The yarn for heat-setting may or may not be subjected to pretumbling or bulking cycle before heat-setting. However, the final effect of the yarn should allow shrinkage differences to occur between the heat-set and nonheat-set yarns in order to achieve the multilevel, colorway effect. The construction of the fabrics can be either cut pile or cut/loop of any guage, or woven, or any other fabrication method. The creeling may be end and end (alternating ends), end and end and end, etc. random threadup or any other threadup. A cut/loop fabric employing a hidden loop pattern when none of the loops are showing at the surfact except for the color, with an end and end creel up will show off the yarn combinations of this invention in the best manner.

The relationship of the different dye affinities of the yarns should be as follows: For yarn group (A), the heat-set yarn component should be of a dye affinity which would allow only relatively light color shades on the heat-set yarn to be applied on dyeing. These light color shades are the typical light dye and medium dye affinity polymers available in industry today. The same is true of the heat-set yarn component of the yarn groups labeled (B) and optionally (C) and the various other yarns to be added. These can be different light dye or medium dye affinities but all these heat-set yarn components must have a relatively light color shade so that the darker shades of the nonheat-set yarns can show through. The nonheat-set yarn component of yarn (A) should be a relatively darker dye polymer type such as medium, dark and including cationic dye affinity yarns. The same is true of the nonheat-set component of the yarn (B), however, this nonheat-set yarn component must be a second relatively dark dye affinity in order to achieve the colorway effect desired.

The light, medium, dark and cationic polymer types can be dyed with acid and cationic dyes. Disperse dyes will affect all polymer types basically in the same manner.

By nonheat-set is meant yarn that has not had the twist or crimp or other similar characteristics stabilized by application of heat and/or steam, such as in an autoclave.

The various types of nylon polymers available to make yarns of different dye affinities are described in U.S. Pat. No. 3,759,893 previously incorporated by reference.

The number of piles of yarns used for this system can be form 1 to about 9. The denier of these yarns can be from about 600 to about 5,000 and the cotton count from about 0.5 to about 10.

EXAMPLE I

The following yarns are prepared: Yarn Group (A)—Two 1220 denier bulked continuous light dye affinity ends of nylon 6 yarn are plied with a 3.5 twist per inch Z twist by 4 twists per inch S twist and autoclave heat-set without a pretumble cycle. Heat-set yarn is then plied (cabled) with a 1225 denier cationic dyeable nylon 6 yarn with no twist that has not been heat-set. The ply twist is 1.75 S. Yarn Group B—Two 1220 denier bulk continuous filament light dye affinity ends of nylon 6 yarn are plied, 3.5 Z by 4.0 S and autoclave heat-set without a pretumble cycle. The heat-set yarn is then plied (cabled) with a 1225 denier deep dye nylon 6 yarn with no twist that has not been heat set. The ply twist is 1.75 S. The two yarn groups are creeled end and end in a cut/loop tufting machine and tufted with a hidden loop pattern into the backing to form a carpet. The carpet is dyed, dried, and finished. A very pleasing frosted effect with two colorways, one at the surface and one lower down in the pile of the carpet results.

EXAMPLE II

The following yarns are prepared: Yarn A—A spun medium dye nylon 6 yarn of 2.5 cc/3 (2/5 cotton count 3-ply yarn) autoclave heat-set with a pretumble cabled with a 1225 denier deep dye nylon 6 yarn which has 0.5 Z twist before the yarn was cabled. Yarn B—A spun medium dye nylon 6 yarn of 2.5 cc/3 autoclave heat-set with a pretumble, cabled with a 1225 denier cationic dye nylon 6 yarn which has 0.5 Z twist before yarn is cabled. These yarns are then woven on a CAROLOC weaving machine. A similar effect is achieved as in Example I.

EXAMPLE III

The same yarn (A) of Example I is used. Yarn B, however, is 1820 denier medium dye, 2-ply nylon 6 yarn 3.25 Z by 3.75 S twist, autoclave heat-set without a pretumble, cabled with 1225 denier deep dye nylon 6 yarn when tufted. This achieves two colors on the surface colorway and two colors in the beneath-the-surface colorway as in Example I.

In the preceding examples the following terms have the following meaning:

| | End Groups in Parts Per Million by Weight | |
|---|---|---|
| Dye Affinity | Amine | Carboxyl |
| Light | 10 | 55 |
| Medium | 50 | 50 |
| Dark | 52 | 8 |
| Cationic | 25 | 92 |

The above polymers were prepared by adding proper amounts of manganous hypophosphite according to the teaching in U.S. Pat. No. 2,887,462 to achieve the following manganese and phosphorous levels:

| | Parts Per Million by Weight | |
|---|---|---|
| Dye Affinity | Manganese | Phosphorus |
| Light | 10 | 10 |
| Medium | 9 | 11 |
| Deep | 10 | 9 |
| Cationic | 12 | 8 |

For cationic dyeable polymer 2600 parts per million of sulfur are also added according to the teaching in U.S. Pat. No. 4,083,893.

The following dye bath was used in an open beck for Examples I and II.

TABLE I

| | Percent on Weight of Fabric |
|---|---|
| Dispersol Blue BG | .03 |
| Xylene Light Yellow R Conc. | .03 |
| Nyloson Blue FL | .38 |
| Astrazon Blue 5 GL | .01 |
| Sevron Red YCN | .15 |
| Maxilon Yellow GL | .022 |
| Genacryl Red BL | .03 |

Add basic dyes first; run cold 5 minutes.
Add 1.0% acetic acid to bath after 30 minutes at temperature.
Ratio: 30-1 (water:fabric)
Temperature: 205° F.
Time: 1 hour
Rate of rise: 3° F./min.

TABLE I-continued

| | Percent on Weight of Fabric |
|---|---|
| Dyeing auxiliary: 1.0% hipochem PND-11 | |
| 1.0% hipochem CDL-60 | |
| Adjust to pH 6.5 | |
| Add 0.25% ammonia to bath after pH has been set. | |

The following dye bath was used in an open beck for Example III.

TABLE II

| | Percent on Weight of Fabric |
|---|---|
| Stylacyl Blue RP | .18 |
| Stylacyl Red RB | .04 |
| Stylacyl Yellow RG | .60 |
| Maxilon Yellow GL | .50 |
| Astrazon Blue 5GL | .11 |
| Sevron Red L | .22 |
| Add basic dyes first; run cold 5 minutes. | |
| Add 1.0% acetic acid to bath after 30 minutes at temperature. | |
| Ratio: 30–1 | |
| Temperature: 205° F. | |
| Time: 1 hour | |
| Rate of rise: 3° F./min. | |
| Dyeing auxiliary: 1.0% hipochem PND-11 | |
| 1.0% hipochem CDL-60 | |
| Adjust to pH 6.5 | |
| Add 0.25% ammonia to bath after pH has been set. | |

We claim:

1. A carpet selected from the group consisting of cut/loop and cut pile carpet having a beneath-the-surface patterning effect, said carpet comprising at least two yarn groups of differing characteristics said yarn groups comprising (A) a multiple ply heat-set yarn having a relatively light dye affinity combined with a nonheat-set yarn having a first relatively darker dye affinity, and (B) a heat-set yarn having a relatively light dye affinity combined with a nonheat-set yarn having a second relatively darker dye affinity, so that said nonheat-set yarns shrink to a lower pile height in said carpet than said heat-set yarn due to the heat and moisture of dyeing and drying said carpet, whereby at least two colorways are established in said carpet pile.

2. The carpet of claim 1 wherein said carpet is tufted with a hidden loop or semihidden loop pattern.

3. The carpet of claim 1 wherein said yarn groups (A) and (B) have the same heat-set yarn component.

4. The carpet of claim 1 wherein said yarn groups (A) and (B) have a yarn component of differing characteristics.

5. The carpet of claim 4 wherein the different characteristics is the number of piles in the yarn.

6. The carpet of claim 5 wherein the yarn components also differ in denier or cotton count of the yarn.

7. The carpet of claim 5 wherein the heat-set yarn components also differ in their light dye affinity.

8. The carpet of claim 4 wherein the different characteristic is the denier or cotton count of the yarn.

9. The carpet of claim 8 wherein the yarn components also differ in dye affinity of the heat-set yarn.

10. The carpet of claim 9 wherein the yarn components also differ in the number of plies in the yarn.

11. The carpet of claim 4 wherein the different characteristic is the light dye affinity of the heat-set yarn.

12. The carpet of claim 1 wherein said yarn groups (A) and (B) are tufted in an end and end relationship.

13. The carpet of claim 1 wherein said yarn groups (A) and (B) are tufted in a randon relationship.

14. The carpet of claim 1 wherein said carpet is woven.

15. The carpet of claim 1 wherein said yarn groups (A) and (B) are tufted with an additional yarn group (C).

16. The carpet of claim 1 wherein said yarn groups (A) and (B) are tufted with an additional yarn group (C), said yarn group (C) comprising a heat-set yarn of relatively light dye affinity combined with a nonheat-set yarn having dye affinity different than said heat-set yarn.

17. The carpet of claim 16 wherein said nonheat-set yarn has a third relatively darker dye affinity.

18. The carpet of claim 16 wherein said carpet is tufted with a hidden loop or semihidden loop pattern.

19. The carpet of claim 16 wherein said yarn groups (A) and (B) have the same heat-set yarn components.

20. The carpet of claim 16 wherein said yarn groups (A) and (B) have a yarn component of different characteristics.

21. The carpet of claim 20 wherein the different characteristic of the yarn component is the number of plies, denier or cotton count or both of them.

22. The carpet of claim 16 wherein said yarn groups (A), (B) and (C) are tufted in an end and end and end relationship.

23. The carpet of claim 16 wherein said yarn groups (A), (B) and (C) are tufted in a randon relationship.

24. The carpet of claim 16 wherein various additional yarns are tufted with yarn groups (A), (B) and (C).

25. The carpet of claim 24 wherein at least one of said additional yarns has at least one yarn component having a characteristic differing from each of yarn groups (A), (B) and (C).

26. The carpet of claim 24 wherein at least one additional yarn has a heat-set yarn component having a characteristic different than the heat-set yarn component of yarn groups (A), (B) and (C).

27. The carpet of claim 24 wherein at least one additional yarn has a heat-set yarn component of the same light dye affinity as yarn groups (A), (B), and (C).

28. The carpet of claim 24 wherein at least one additional yarn has a nonheat-set yarn component having a characteristic different than the nonheat-set yarn component of yarn groups (A), (B) and (C).

29. The carpet of claim 24 wherein the different characteristics of the yarn component of the additional yarn is the number plies, denier or cotton count and/or dye affinity.

30. The carpet of claim 1 wherein said yarn groups are of the same general type and said heat-set yarn in groups (A) and (B) consists of a polymer selected from the group consisting of light and medium dye affinity polymers, and said nonheat-set yarn in groups (A) and (B) consists of a polymer independently selected from the group consisting of medium, dark and cationic dye affinity polymers.

31. The carpet of claim 30 wherein the type of polymer is nylon.

32. The carpet of claim 30 wherein the type of polymer is a polyester.

33. A method to make a beneath-the-surface patterning effect for cut/loop and cut pile carpets with at least two yarn groups of different characteristics comprising fabricating said yarn groups into a pile fabric with a pattern that will establish at least two colorways, dyeing said carpet tufted from said yarns, and drying said carpet, said yarn groups comprising (A) a multiple ply heat-set yarn having a relatively light dye affinity combined with a nonheat-set yarn having a first relatively darker dye affinity and (B) a heat-set yarn having a relatively light dye affinity combined with a nonheat-set yarn having a second relatively darker dye affinity, so that said nonheat-set yarns shrink to a lower pile height in said carpet than said heat-set yarns due to the heat and moisture of dyeing and drying said carpet, whereby at least two colorways are established in said carpet pile.

34. The method of claim 33 wherein said yarn groups (A) and (B) are tufted in an end and end relationship.

35. The method of claim 33 wherein said yarn groups (A) and (B) are tufted in a random relationship.

36. The method of claim 33 wherein said yarn groups (A) and (B) are woven into a pile fabric.

37. The method of claim 33 wherein said yarn groups (A) and (B) have the same heat-set yarn component.

38. The method of claim 33 wherein said yarn groups (A) and (B) have a yarn component of differing characteristics.

39. The method of claim 38 wherein the different characteristic is a number of plies in the yarn.

40. The method of claim 39 wherein the components also differ in denier or cotton count of the yarn.

41. The method of claim 39 wherein the heat-set components also differ in their light dye affinity.

42. The method of claim 39 wherein the different characteristic of the yarn component is the number of plies, dye affinity, denier or cotton count or any combination of them.

43. The method of claim 38 wherein the different characteristic is the denier or cotton count of the yarn.

44. The method of claim 43 wherein the heat-set components also differ in dye affinity of the yarn.

45. The method of claim 44 wherein the yarn components also differ in the number of plies in the yarn.

46. The method of claim 38 wherein the different characteristic is a light dye affinity of the heat-set yarn.

47. The method of claim 33 wherein said yarn groups (A) and (B) are tufted with an additional yarn group (C).

48. The method of claim 47 wherein said yarn groups (A), (B) and (C) are tufted in an end and end and end relationship.

49. The method of claim 47 wherein said yarn groups (A), (B) and (C) are tufted in a random relationship.

50. The method of claim 47 wherein various additional yarns are tufted with yarn groups (A), (B) and (C).

51. The method of claim 50 wherein at least one of said additional yarns has at least one yarn component having a characteristic differing from each of the yarn groups (A), (B) and (C).

52. The method of claim 50 wherein at least one additional yarn has a yarn component having a characteristic different than a yarn component of yarn groups (A), (B) and (C), said characteristic being plies, denier or cotton count, dye affinity and/or a combination of them.

53. The method of claim 33 wherein said yarn groups (A) and (B) are tufted with an additional yarn group (C), said yarn group (C) comprising a heat-set yarn of relatively light dye affinity combined with a nonheat-set yarn having a third relatively darker dye affinity.

54. The method of claim 53 wherein said yarns (A) and (B) have the same heat-set yarn component.

55. The method of claim 53 wherein said yarns (A), (B) and/or (C) have a yarn component of differing characteristics.

56. The method of claim 53 wherein at least one additional yarn has a heat-set yarn component of the same light dye affinity as yarn groups (A), (B) and (C).

57. The method of claim 33 wherein the dyeing is accomplished with a dye selected from the group consisting of acid and cationic dyes, or both.

* * * * *